US006655099B1

(12) United States Patent
Trenoweth

(10) Patent No.: US 6,655,099 B1
(45) Date of Patent: Dec. 2, 2003

(54) CLIP FASTENING SYSTEM FOR WALLS

(75) Inventor: Mark Grahame Trenoweth, Kingston (AU)

(73) Assignee: Spanbilt Pty Ltd (AU)

( * ) Notice: Subject to any disclaimer, the term of this patent is extended or adjusted under 35 U.S.C. 154(b) by 0 days.

(21) Appl. No.: 09/787,076

(22) PCT Filed: Sep. 14, 1999

(86) PCT No.: PCT/AU99/00765

§ 371 (c)(1),
(2), (4) Date: Mar. 13, 2001

(87) PCT Pub. No.: WO00/15917

PCT Pub. Date: Mar. 23, 2000

(30) Foreign Application Priority Data

Sep. 14, 1998 (AU) ..... PP5885

(51) Int. Cl.[7] ..... E04H 1/00; E04H 5/00; E04H 6/00; E04H 14/00; E04H 3/00

(52) U.S. Cl. ..... 52/243; 52/489.1; 52/696; 52/522; 52/715

(58) Field of Search ..... 52/715, 243, 696, 52/712, 241, 242, 357, 358, 359, 290, 264, 265, 713, 489.1, 489.2, 293.3, 588.1, 522, 481.2, 483.1, 281

(56) References Cited

U.S. PATENT DOCUMENTS

| | | | | | |
|---|---|---|---|---|---|
| 4,377,060 | A | * | 3/1983 | Ragland | 52/489.2 |
| 4,448,007 | A | * | 5/1984 | Adams | 52/489.2 |
| 4,610,562 | A | * | 9/1986 | Dunn | 403/191 |
| 5,157,883 | A | * | 10/1992 | Meyer | 24/460 |
| 5,228,263 | A | * | 7/1993 | Vaughn | 52/238.1 |
| 5,622,020 | A | * | 4/1997 | Wood | 52/546 |
| 5,669,198 | A | * | 9/1997 | Ruff | 248/222.52 |
| 5,911,663 | A | * | 6/1999 | Eidson | 52/409 |
| 5,927,038 | A | * | 7/1999 | Goldberg et al. | 403/109.1 |
| 5,966,893 | A | * | 10/1999 | Quillin | 52/282.2 |
| 6,058,859 | A | * | 5/2000 | Colosimo, Jr. | 110/332 |
| 6,101,780 | A | * | 8/2000 | Kreidt | 52/281 |
| 6,298,623 | B1 | * | 10/2001 | Wendt | 248/343 |
| 6,301,855 | B1 | * | 10/2001 | Aerni | 403/232.1 |
| 6,427,416 | B1 | * | 8/2002 | Rassel | 52/714 |

FOREIGN PATENT DOCUMENTS

| | | |
|---|---|---|
| EP | 0 346 002 | 12/1989 |
| EP | 0 420 633 | 4/1991 |
| WO | PCT/US79/00981 | 4/1991 |

* cited by examiner

*Primary Examiner*—Carl D. Friedman
*Assistant Examiner*—Chi Q. Nguyen
(74) *Attorney, Agent, or Firm*—Kirton & McConkie; Michael F. Krieger

(57) ABSTRACT

A clip is used to fasten a wall panel to a frame rail. The clip is fitted to the rail and has paul-like tabs which locate in apertures in a side wall of the rail. Corresponding apertures are provided on the edge of the wall. When the edge of the wall is inserted into the clip, the pawl-like tabs snap-fit through the apertures and into the apertures, thereby captively retaining the wall to the rail. Alternatively, the clip may be formed integrally with a rail by pressing out a flap from a side wall of the rail. Each flap has a pawl-like indent. Corresponding apertures are provided on the edge of a wall sheet. When the edge of the wall sheet is inserted between the flaps and the rail, the pawl-like indents locate in the apertures, thereby captively retaining the wall sheets to the rail.

9 Claims, 17 Drawing Sheets

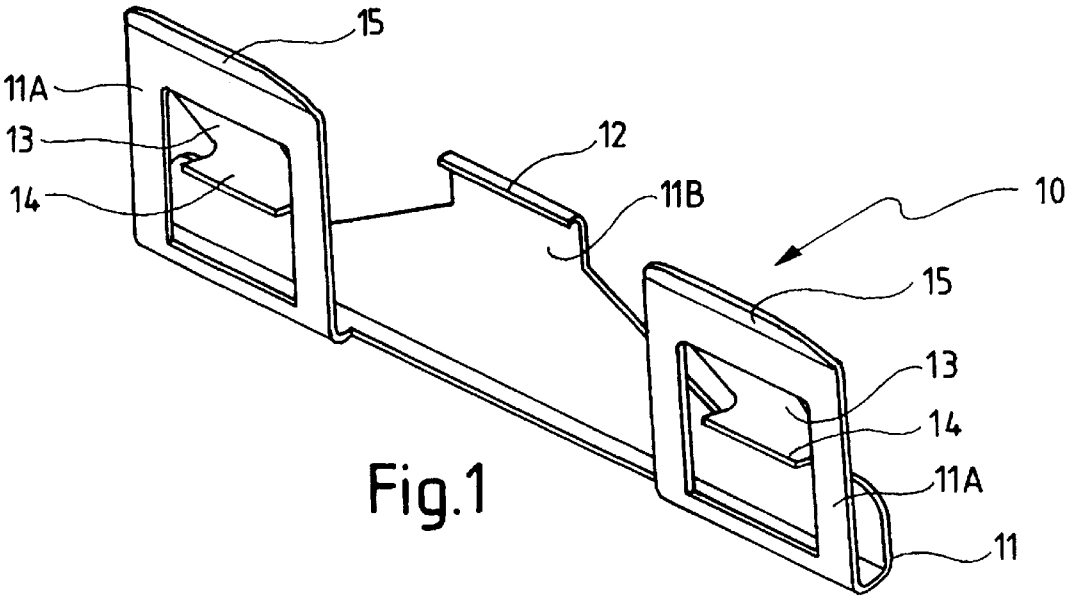
Fig.1
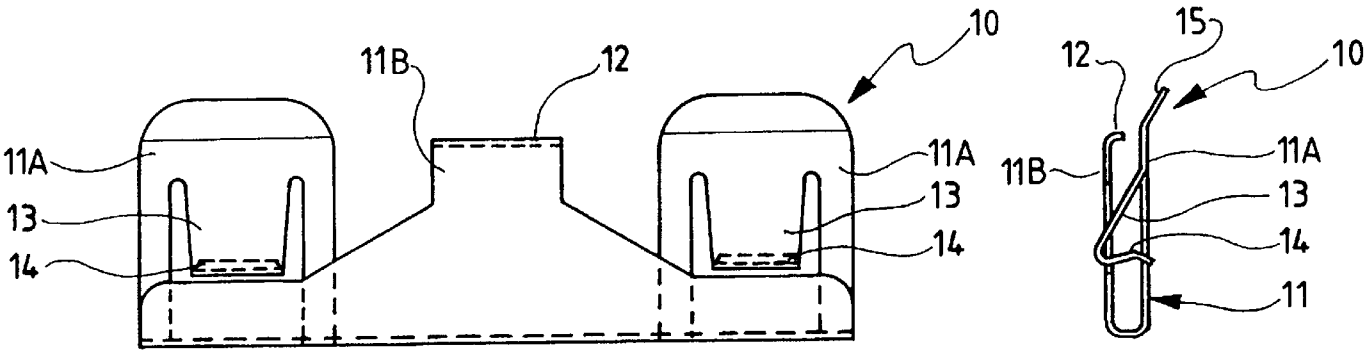
Fig. 2
Fig. 3

CLIP FASTENING SYSTEM FOR WALLS

THIS INVENTION relates to a clip fastening system. The invention is particularly, but not solely, directed to the use of clip-like fittings to fasten metal wall sheets to top and bottom rails of a frame, to thereby facilitate the assembly and erection of prefabricated small structures or buildings such as garden sheds, garages, shadehouses, aviaries and the like.

BACKGROUND ART

Many small structures, such as garden sheds, storage sheds, cubby houses, etc., are sold in kit form for assembly by the customer. The assembly or erection of such structures usually requires the customer to fasten wall sheets to frame components, such as top and bottom rails. Such components are normally fastened together by rivets or screws.

The screwing or riveting of wall sheets is tedious and time consuming. Such methods of fastening may also require two persons, one to hold the components in place, and the other to screw or rivet them together. Furthermore, many customers do not have a rivet gun readily available. For the foregoing and other reasons, potential customers are often deterred from buying garden sheds and other structures which they have to assemble themselves.

U.S. Pat. No. 5,325,651 describes a method of constructing a wall frame for a building in which vertical frame members (studs) are secured to horizontal frame members (plates) by clips or brackets and deformations formed in the plates. Although this method avoids the use of screws and rivets, it requires separate locking clips 18. Furthermore, although the method of U.S. Pat. No. 5,325,651 is suitable for fixing frame members to each other, the wall sheets must still be fixed to the studs and plates by screwing or riveting.

It is an object of this invention to provide a clip fastening system which facilitates and/or expedites the assembly and erection of small structures, or which at least provides a competitive alternative to known erection/assembly systems.

SUMMARY OF THE INVENTION

In one form, the invention provides a method of fixing a generally planar wall member to an elongate frame member of a small metal building, including the steps of providing a plurality of clip-like fittings at spaced locations along the frame member, each clip-like fitting having a resilient detent, providing a plurality of apertures adjacent an edge portion of the wall member at spaced locations corresponding to the clip-like fittings, and fixing the wall member to the frame member by inserting the edge portion into the clip-like fittings such that the detents of the clip-like fittings locate respectively in the apertures and thereby captively retain the wall member to the frame member.

In another form, the invention provides an assembly for constructing a small metal building, including at least one elongate frame member, a plurality of clip-like fittings attached or attachable to the frame member at spaced locations along its length, each clip-like fitting having at least one resilient detent, and at least one generally planar wall member having a plurality of apertures adjacent an edge portion thereof at spaced locations corresponding to the clip-like fittings on the frame member, whereby the edge portion is insertible in the clip-like fittings to cause the detents to locate respectively in the apertures and captively retain the wall member to the frame member.

Throughout this specification, where the context permits, the term "small metal building" shall include a garden shed, storage shed, garage, shadehouse, cubbyhouse, aviary or similar structure.

The frame member is typically a U-shaped channel section which may serve as a top or bottom rail of the frame. The wall member is typically a side wall of the structure, e.g. formed of roll-formed metal sheet. Normally, the bottom edge of the side wall is first fastened to a bottom rail of the frame in a push-lock action, and then a top rail is fastened to the top of the side wall in a similar manner.

In one embodiment of the invention, each clip-like fitting is formed separately from the frame element, but attachable thereto. The clip-like fitting comprises a generally U-shaped body having two spaced opposing sides, at least one side having a resiliently flexible detent extending inwardly towards the other side.

More preferably, one side of the U-shaped body has two spaced riser portions, each having an inwardly directed pawl-like detent. This detent is typically formed integrally with the fitting, by pressing and deforming a tab in each riser portion. The other side of the U-shaped body has a single riser portion located between the two riser portions on the opposite sides. The single riser portion has a hook-like fitting at the top thereof.

In this embodiment, slots are provided in the channel-shaped frame member at the predetermined spaced locations to receive the clip-like fittings. The riser portions of each clip-like fitting are inserted through slots formed in the frame member, and the hook-like formation retains the clip-like fitting to the frame member.

Apertures are provided adjacent an associated edge of the side wall at locations corresponding to the detents on the clip-like fitting. When the edge portion of the side wall is inserted between the frame member and the clip-like fitting, the detents locate in the apertures, and prevent the side wall from being pulled out of engagement with the frame member. Hence, a side wall can be manually fastened to a frame element in a simple "push lock" manoeuvre.

In another embodiment, each clip-like fitting is formed integrally with the channel-shaped frame member by pressing a flap outwardly from a side wall of the frame member, and forming an inwardly directed detent on the flap. When an edge portion of side wall having apertures at predetermined locations thereon is inserted between the side wall of the frame member and the flap, the detents on the flaps locate in respective apertures, and prevent the side wall from being pulled out of engagement with the frame.

Advantageously, an outwardly-directed detent is formed in the side wall of the frame member between each pair of flaps which each have an inwardly directed detent. The three detents locate in corresponding apertures in the edge portion of a side panel when the edge portion of the side panel is fastened to the frame, the oppositely directed detents providing secure retention of the side wall to the frame.

In yet another embodiment of the invention, the frame member is an upright post of the frame, and the clip-like fittings are provided at vertically spaced locations on the post. The wall member is a side panel which spans between posts and is fastened to the clip-like fittings on the posts in a push-lock action.

In order that the invention may be more fully understood and put into practice, preferred embodiments thereof will now be described, by way of example only, with reference to the accompanying drawings.

BRIEF DESCRIPTION OF THE DRAWINGS

FIG. 1 is a perspective view of a clip suitable for use in the clip fastening system of this invention, FIG. 2 is a front elevation of the clip of FIG. 1, FIG. 3 is an end elevation of the clip of FIG. 1.

DESCRIPTION OF PREFERRED EMBODIMENTS

Figure 4:
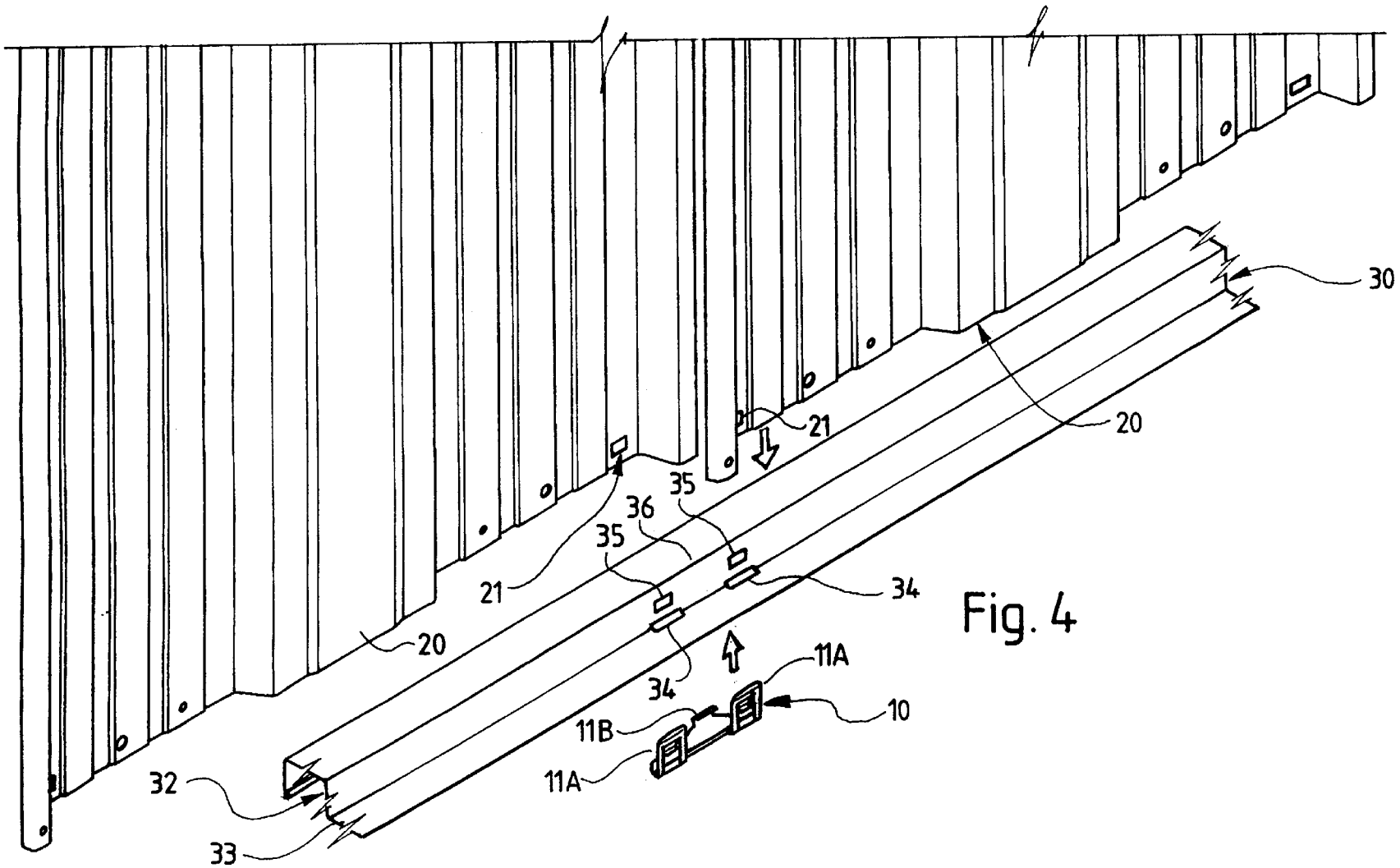
FIG. 4 is an exploded view of components of the clip fastening system prior to assembly, including the clip of FIG. 1.

As shown in FIGS. 1–3, a fastening clip 10 is in the form of a generally U-shaped body 11. One side of the body 11 has two spaced riser portions 11A, while the other side of the body 11 has a single riser portion 11B located between the two portions 11A, as shown in FIG. 1

The upper edge of portion 11B is turned inwardly to form a lip 12 which has a hook-like function, as described below. Each portion 11A has a punched out tab 13 which is bent inwardly towards the other side of the clip, to form a pawl-like formation, as shown in FIG. 3. The tab 13 has a return portion 14 at its bottom. Each portion 11A also has an angled flange 15 at its top.

The clip 10 is typically formed from metal sheet which is generally stiff, but has a suitable degree of resilient flexibility. The clip is normally made by punching and pressing operations.

The clip 10 can be used to fasten wall panels to frame members in the erection or assembly of small metal buildings, such as garden sheds. FIGS. 4–7 illustrate the use of the clip 10 to fasten wall sheets 20 to a channel which forms the bottom plate or rail 30 of a building frame. The rail 30 is typically an elongate metal strip which has been roll formed into an inverted channel section 32 with a laterally extending flange or tab 33. This flange or tab is usually fixed to a floor structure. However, any other suitable cross section may be used.

At predetermined locations along its length, the rail 30 is provided with (i) a pair of spaced elongate apertures 34 located at the junction of the flange 33 and the adjacent side wall of the channel section 32, (ii) a pair of apertures 35 located in the face of that side wall, each above a respective one of the apertures 34, and (iii) an elongate aperture 36 located at the junction of that side wall and the web of the channel section, between the apertures 35, 34.

The apertures 34, 35, 26 are typically punched in the sheet before it is roll formed.

Corresponding apertures 21 are provided at predetermined locations along the bottom of the wall sheets 20. The apertures 21 are formed in pairs, and spaced to correspond in position with apertures 35. Preferably, an aperture 21 is provided near each vertical edge of a wall sheet 20. The edges of the wall sheets are roll formed, and designed to overlap or nest one within the other. The apertures 21 are located such that when the roll formed edges of the wall sheets overlap, the spacing between the apertures 21 correspond to the spacing between the apertures 35.

Figure 5:
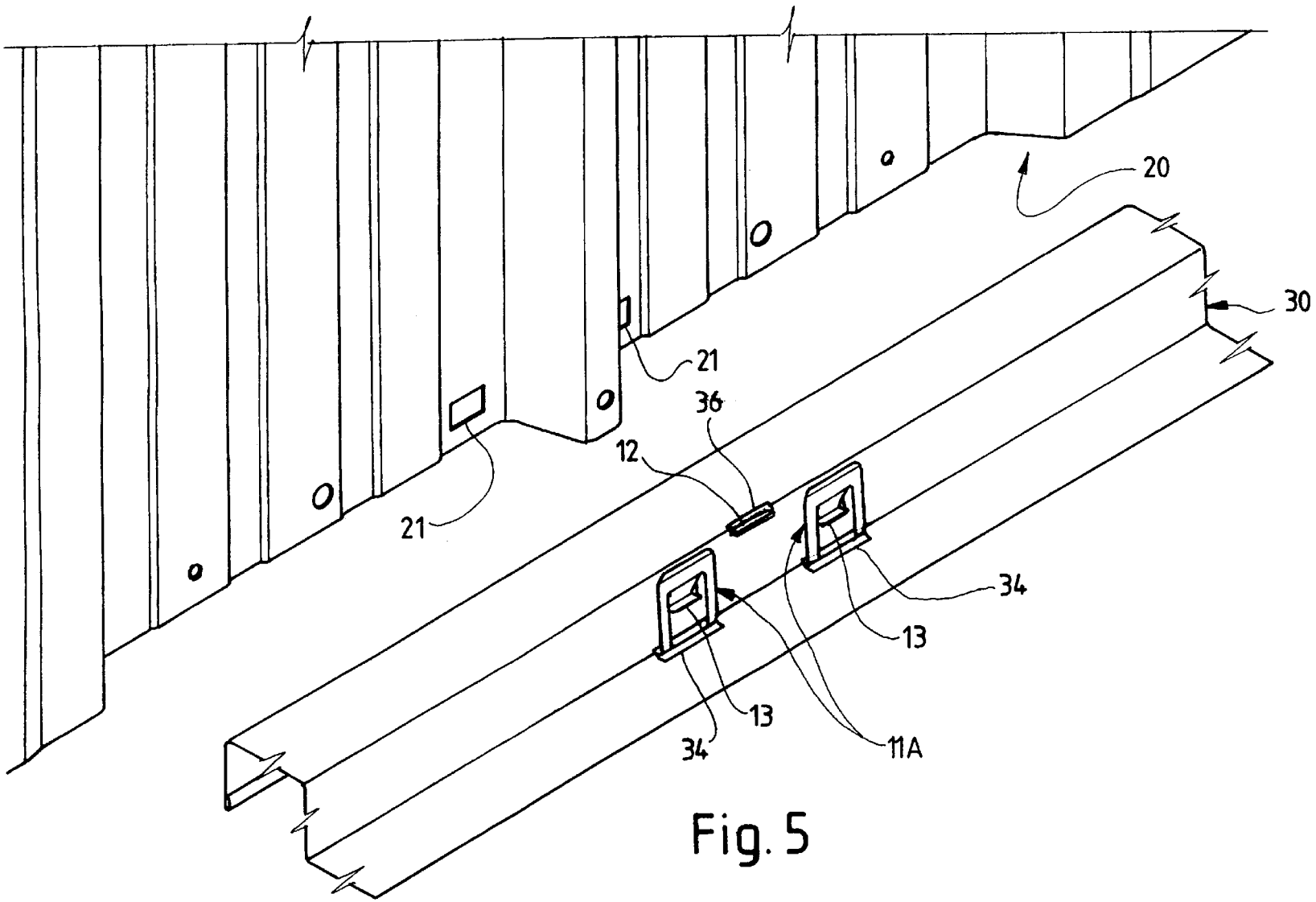
FIG. 5 is an exploded view of the components of FIG. 4 partially assembled.

In use, the clip 10 is first inserted into the rail 30, as shown in FIG. 5. The clip 10 is inserted in the direction shown in FIG. 4, i.e. from under the rail. (This can be done by first inverting the rail 30 and pushing the clip down into the rail). The clip 10 is inserted such that the risers 11A pass through the apertures 34. The pawl-like tabs 13 may deflect as they pass through apertures 34 but they spring back and locate in apertures 35 of the channel portion 32 as shown in FIG. 7.

The middle riser 11B locates on the inside of the side wall of the channel section 32 such that the lip 32 passes through aperture 36 and hooks over the bottom edge of that aperture. That is, the lip 12 hooks onto the channel section 32 and prevents the clip from being pushed out of engagement with the rail 30. In this manner, the clip is retained securely in position in the rail.

Figure 6:
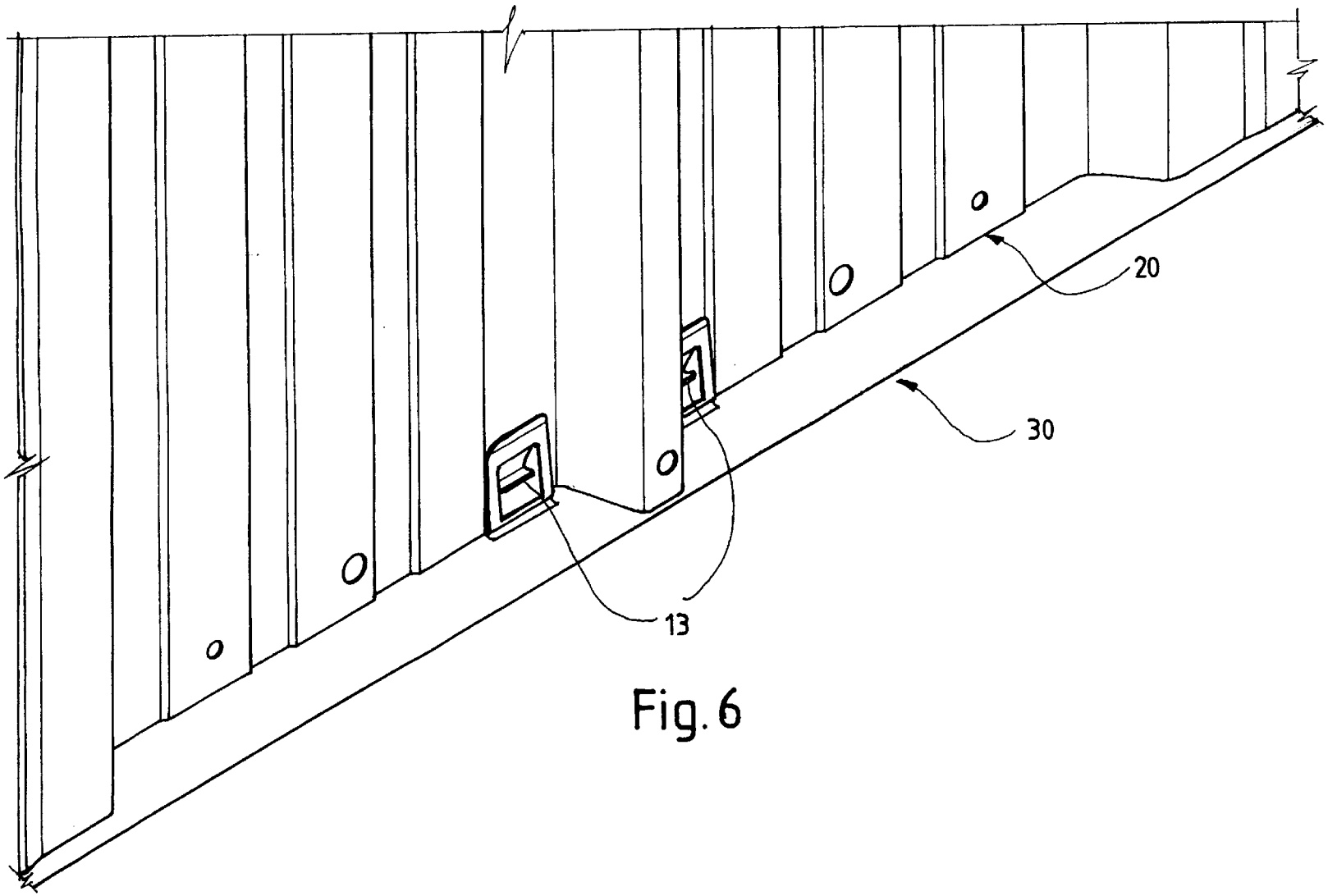
FIG. 6 is a perspective view of the components of FIG. 4 when assembled.

Once the roll formed vertical edges of the wall sheets 20 have been overlapped as shown in FIG. 5, the overlapped wall sheets are positioned over the rail 30 so that the apertures 21 in the wall sheets are located above the tabs 13. The wall sheets are then pressed down into the rail/clip assembly as shown in FIG. 6, the wall sheets passing between the side wall of the channel section 32 and the outer wall of the clip 10 containing the portions 11A. This outer wall may flex outwardly, until the apertures 21 register with the. tabs 13, whereupon the tabs 13 snap-fit in the apertures 21 and lock the wall sheets to the rail 30. The flanges 15 assist in guiding the wall between the channel section 32 and outer wall of clip 10.

Figure 7:
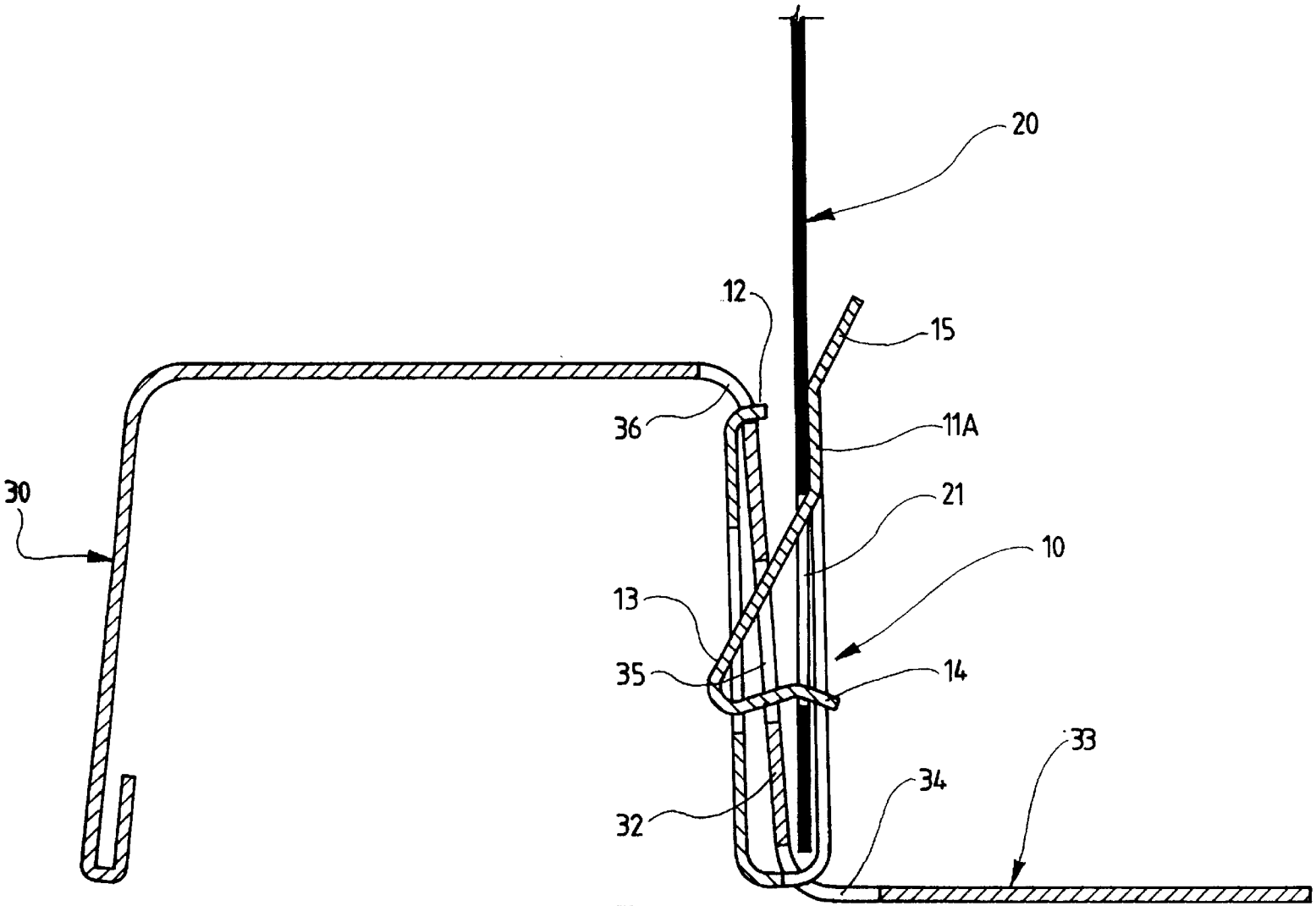
FIG. 7 is a schematic sectional elevation of the assembled components of FIG. 6.
Figure 8:
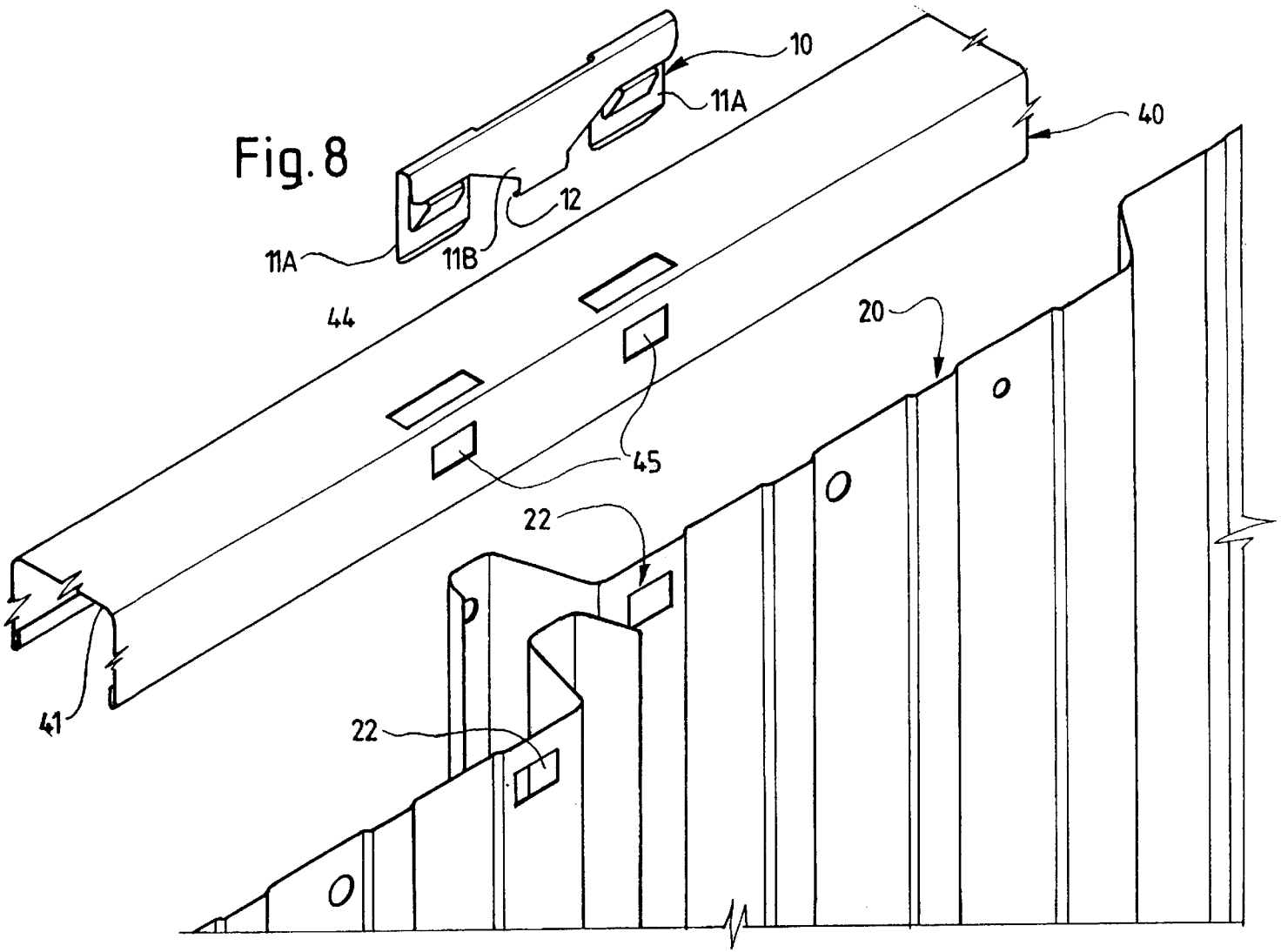
FIG. 8 is an exploded view of other components of the clip fastening system prior to assembly, including the clip of FIG. 1.

As shown more clearly in the sectional drawing of FIG. 7, as the wall sheet 20 is pressed down between the rail 30 and the clip 10, it deflects the resilient tab 13 slightly outwardly. However, once an aperture 21 registers with a corresponding tab 13, the resilient pawl-like tab 13 springs back into the aperture. The re-entrant or bottom portion 14 of the tab traverses the bottom edge of the aperture 21, and prevents the wall sheet from being pulled upwardly out of engagement with the rail/clip assembly.

The above procedure is.repeated along the walls progressively so that all of the wall sheets are locked to the bottom rail.

A top rail of the structural frame is then fastened to the top of the wall sheets in a similar manner, as illustrated in FIGS. 8–11. The top rail 40 comprises an inverted channel section 41 having a pair of spaced apertures 44 at the junction of the web and a side wall thereof, as well as a pair of spaced apertures 45 in the side wall, below the respective apertures 44. The spacing between the apertures corresponds to the spacing between the riser portions 11A of the fastening clip 10.

Figure 9:
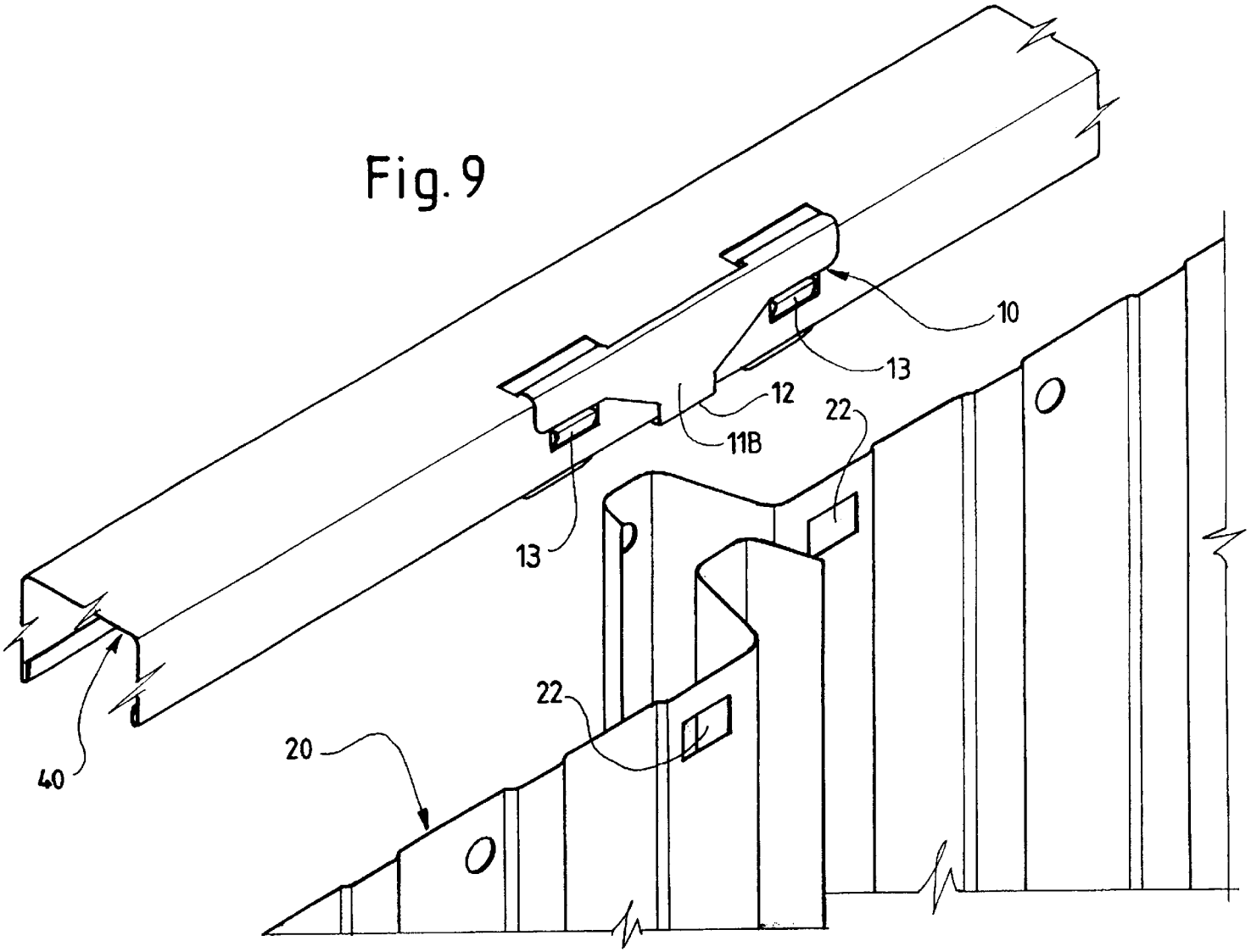
FIG. 9 is an exploded view of the components of FIG. 8 partially assembled.

In use, the clip 10 is first inserted in the apertures in the top rail 40. The portions 11A of the clip are inserted through the apertures 44, so that the tabs 13 locate in apertures 45. The middle portion 11B passes on the outside of the rail, and the lip 12 hooks onto the bottom edge of the rail, as can be seen in FIG. 9.

The top edges of the wall sheets are provided with apertures 22 adjacent the roll formed vertical edge portions. When the edge portions are nested, the spacing between the apertures 22 corresponds to the spacing between the apertures 45.

Figure 10:
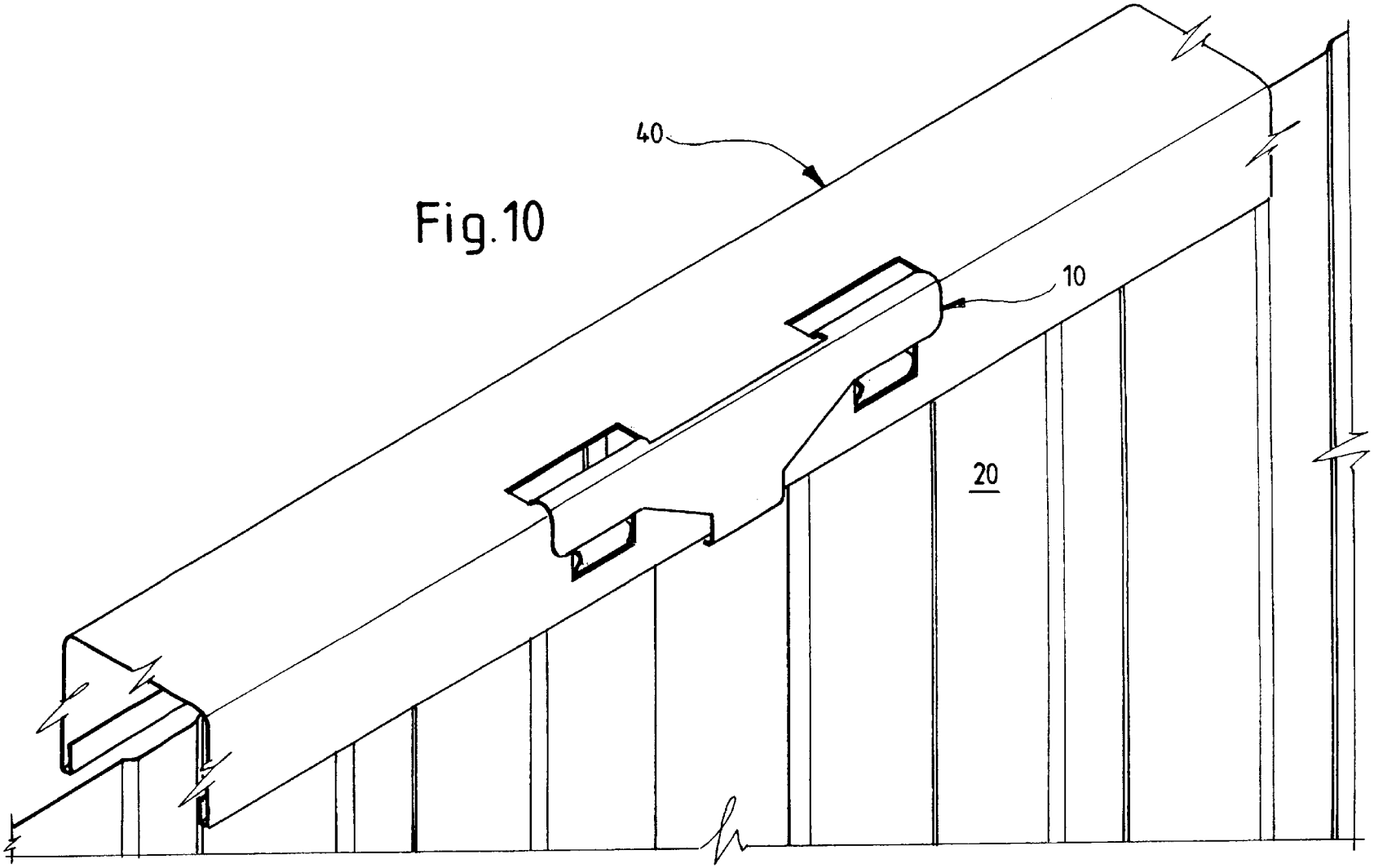
FIG. 10 is a perspective view of the components of FIG. 8 when assembled.

Once the roll formed edge portions of the wall sheets are nested, the top rail/clip assembly is located over the wall sheets, with the apertures 45 directly above the apertures 22. The rail/clip assembly is then pushed down onto the wall sheets so that the wall sheets pass between the portions 11A and the side wall of the rail 40. The resilient tabs 13 lock into the apertures 22 of the wall sheets, as depicted in FIG. 10.

Figure 11:
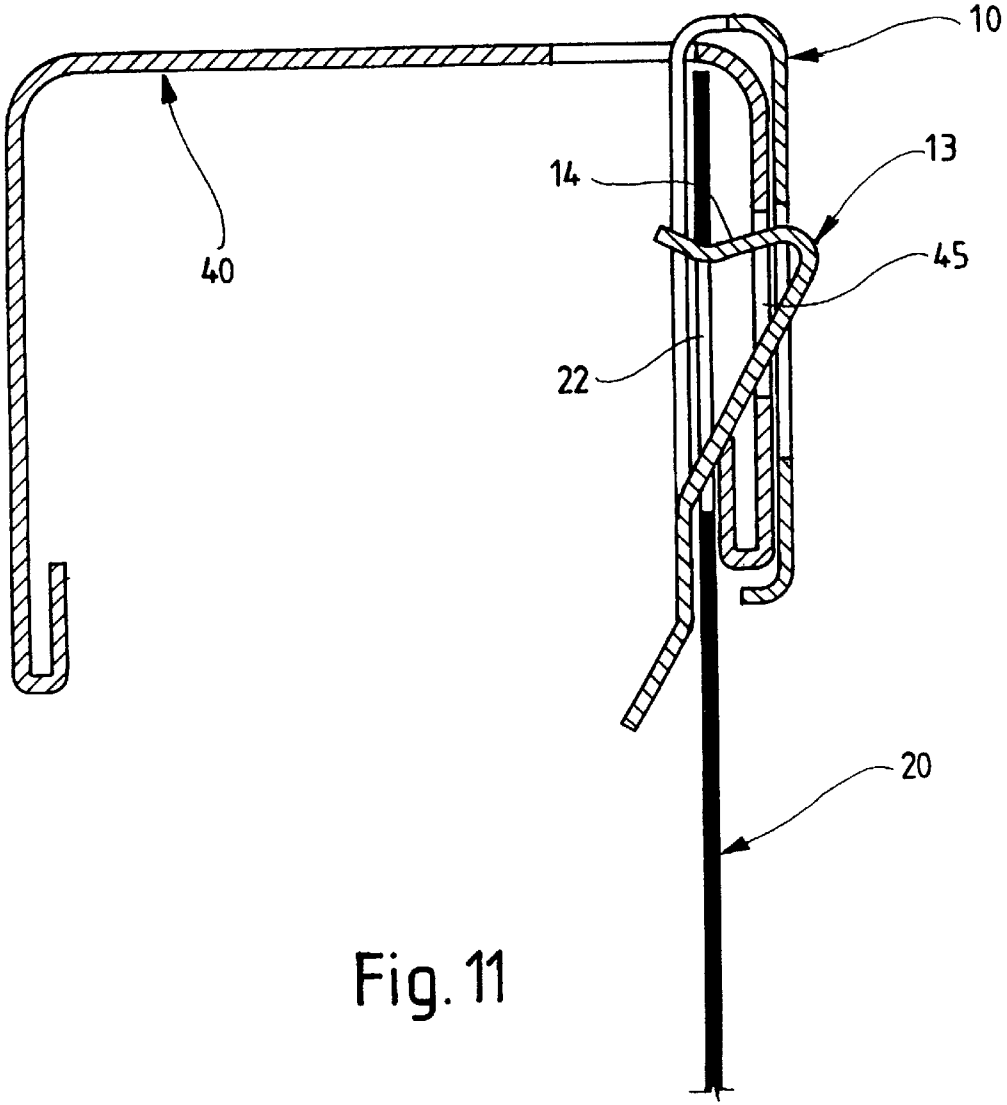
FIG. 11 is a sectional elevation of the assembly of FIG. 10.

FIG. 11 illustrates how the top rail 40 is locked onto the wall sheets 20 by the clip 10. Namely, the tab 13 springs through a corresponding aperture 22 as the wall sheet slides past the deflected tab 13, and the return portion 14 of the tab prevents the rail/clip assembly from being pulled off the wall sheets.

The clip 10 thereby enables the wall sheets to be fastened to the top and bottom rails of a structural frame in a simple push-lock arrangement, without the need for special tools. The clip can be constructed simply and economically, from commonly available material. No major modification is required to the rails and the wall sheets, apart from some apertures which can be easily punched.

In the abovedescribed embodiment, the clip is a separate element, which is inserted into a rail to form a combined clip/rail assembly before being fixed to the wall sheets. In another embodiment of. the invention, the clip is formed as an integral portion of the rail.

Figure 12:
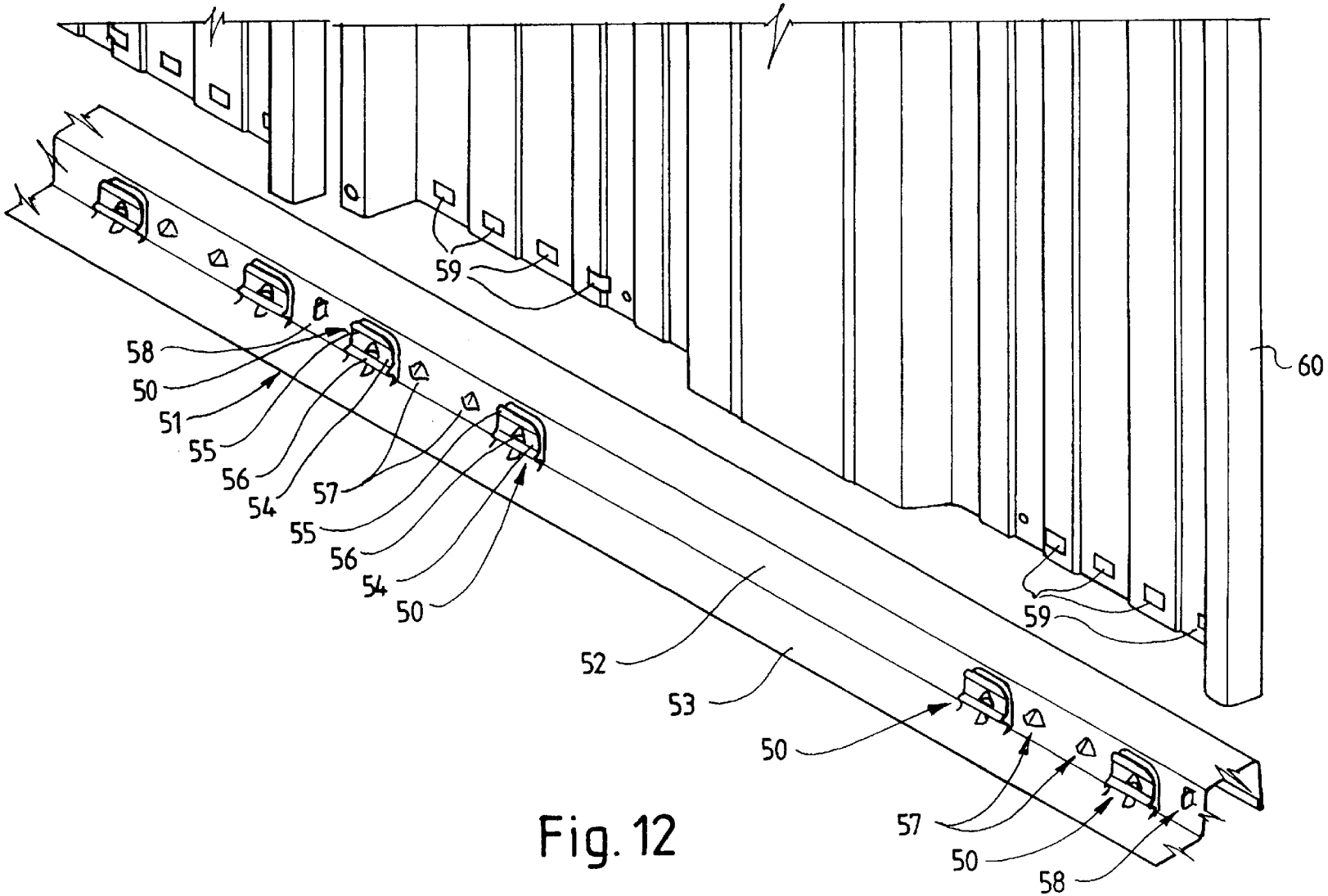
FIG. 12 is a perspective view of components of a clip fastening system prior to assembly, according to a second embodiment of the invention.
Figure 13:
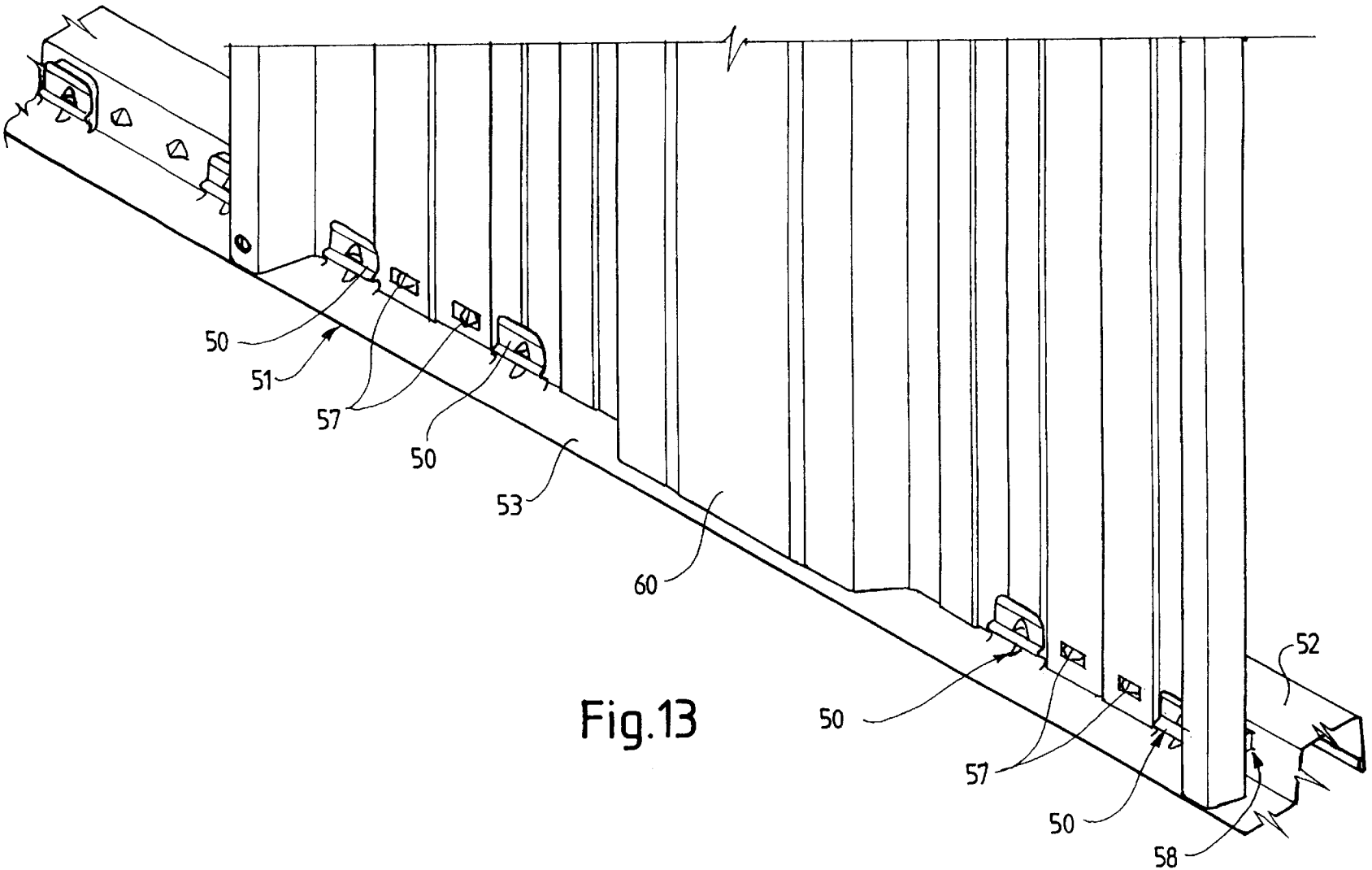
FIG. 13 is a perspective view of the components of FIG. 12 when assembled.
Figure 14:
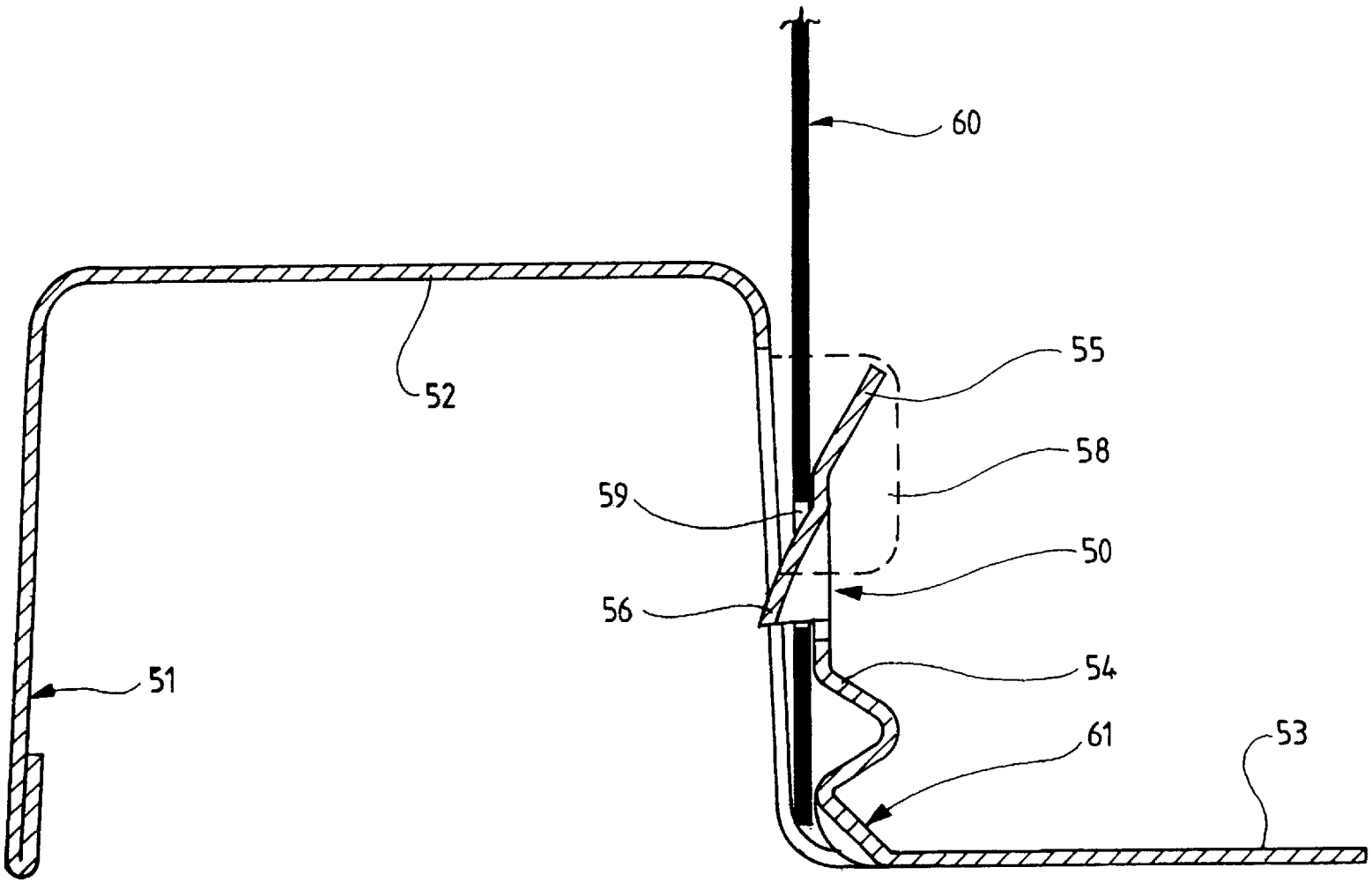
FIG. 14 is a sectional elevation of the assembled components of FIG. 13.

As shown in FIGS. 12–14, a plurality of clips 50 are formed in a rail 51 at predetermined spaced locations along the rail. The rail has a similar cross section to the bottom rail of the embodiment of FIG. 4, namely a channel section 52 formed by a web and two side walls, and a flange 53 extending from the bottom of one of the side walls.

Each clip 50 is formed by punching and pressing out a flap 54 from the side wall of the channel section 52. The top part 55 of the flap is bent outwardly to facilitate the entry of a wall sheet into the gap between the flap and the side wall of the channel section. A centre portion of the flap 54 is pushed inwardly to form an indent 56.

Reverse indents, i.e. outwardly protruding deformations 57, are formed on the side wall of the channel section, between each pair of clips 50. Preferably, a locating tab 58 is formed on the side wall at a location corresponding to the edge position of the wall sheet when inserted.

Elongate slots 59 are formed on the bottom of the wall sheets 60. These slots or apertures 59 correspond in spacing to the indent 56 and the reverse indents 57.

In use, a wall sheet 60 is located over the bottom rail, so that the apertures 59 register vertically with the indents 56 and 57. The tabs 58 assist in locating the ends of the wall sheet at the proper locations. The wall sheet is then pressed down into the gap between the side wall of the channel section 52 and the flaps 54 as shown in FIG. 13.

Due to the resilient flexibility of the flaps 54, they deform outwardly as the wall sheet 60 is pushed down. However, once the apertures 59 register with the indents 56 and 57, the flaps 54 spring back, causing the pawl-like indents 56 to locate in the outer apertures 59, and the reverse indents 57 to locate in the middle aperture 59. These indents lock the wall sheet in position, preventing it from being pulled upwardly out of the clips 50.

Preferably, at least one stiffening rib 61 is formed at the base of each flap 54 (FIG. 14), e.g. by pressing out a gusset-like indentation at the junction of the flap 54 and the flange 53.

Figure 15:
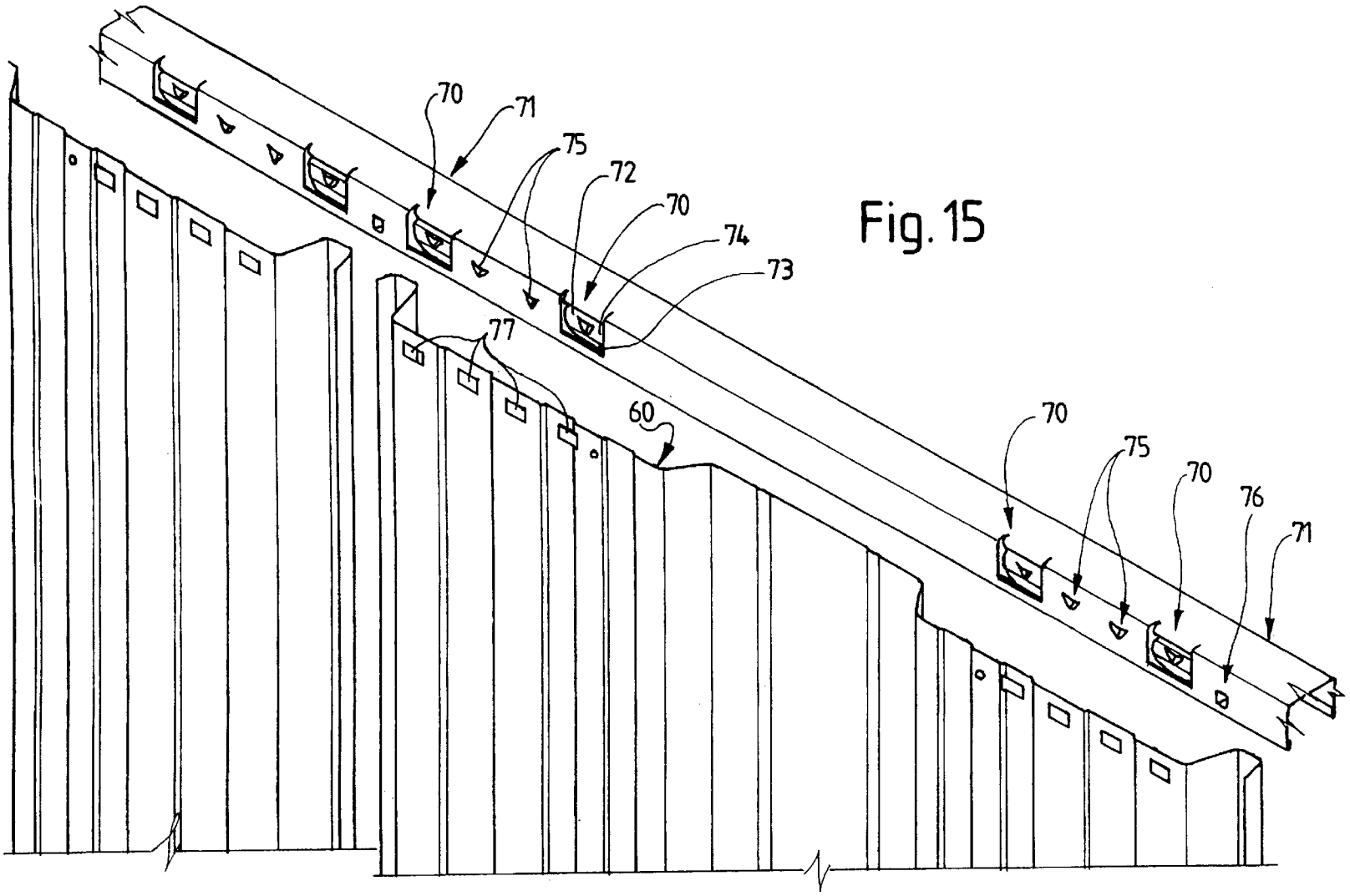
FIG. 15 is a perspective view of other components of the clip fastening system prior to assembly, according to the second embodiment of the invention.
Figure 16:
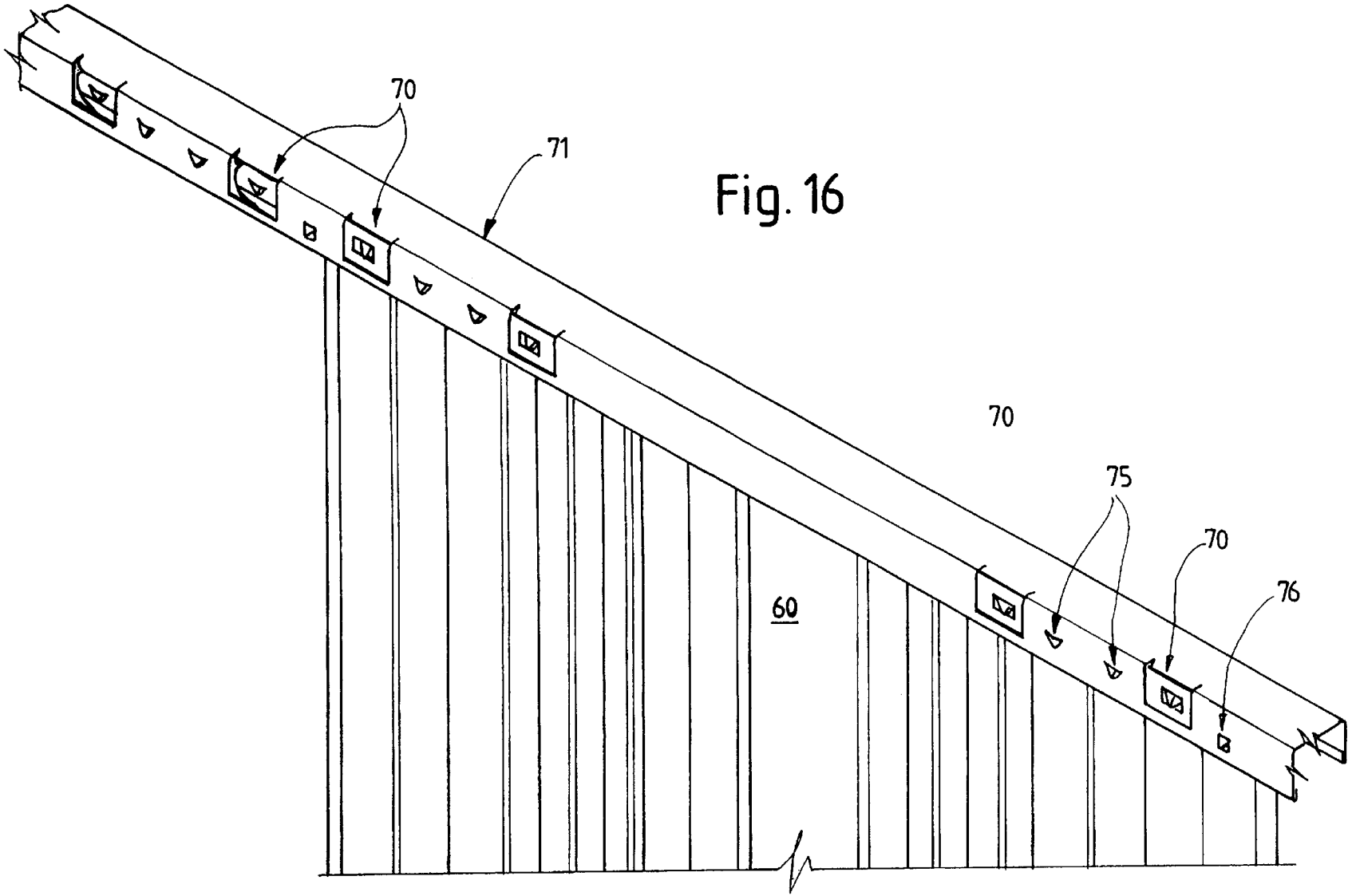
FIG. 16 is a perspective view of the components of FIG. 15 when assembled.
Figure 17:
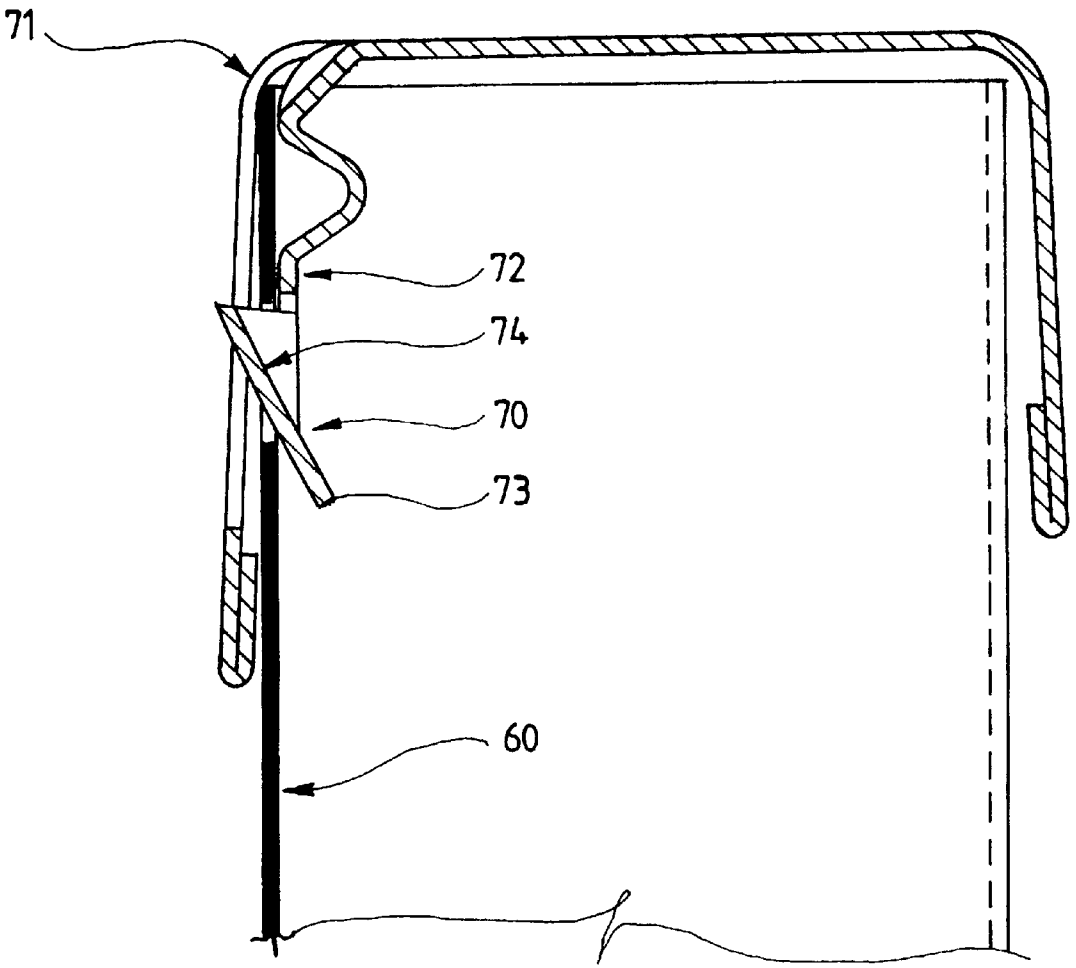
FIG. 17 is a sectional elevation of the assembled components of FIG. 16.

Fastening clips may also be formed integrally with a top rail, as illustrated in FIGS. 15–17. Each clip 70 in the top rail 71 is formed by pressing inwardly a flap 72 in the side wall of the channel-shaped rail 71. The free edge 72 of the flap 72 is bent further inwardly, to facilitate the entry of the top of a wall sheet between the flap 72 and the side wall of the rail 71.

An outwardly directed indent 74 is formed in the centre of each flap 72. Reverse indents 75, i.e. protruding into the channel-shaped rail 71, are formed in the rail side wall between each pair of clips 70. Wall sheet locating tabs 76 are conveniently formed on the side wall of the rail 71, at locations marking the desired position of the edge of a wall sheet.

Sets of apertures are formed at spaced locations along the top of the wall sheets 60. Each set of apertures 77 comprises three rectangular slots, corresponding in spacing to the indents 74 and the reverse indents 75.

In use, once a wall sheet 60 has been placed in the desired position relative to the top rail, as indicated by the locating tab 76, the rail 71 is then pressed down onto the wall sheet, with the top edge of the wall sheet passing between the channel rail 71 and the inwardly deformed flap 72 of each associated clip 70. As the rail 71 is pushed down onto the wall sheet 60 and the apertures 77 register with the indents 74, 75, the flaps 72 spring back and the pawl-like indents 74, 75 locate in their respective apertures 77. These indents prevent the top rail from being pulled upwardly off the top of the wall sheet 60, as shown in FIG. 17.

The clip fastening system of this invention enables small structures to be erected quickly and easily by one person, without the aid of special tools.

The reverse indents 57 and 75 on the bottom and top rails, respectively, may be omitted as the indents 56 and 74 are sufficient to fasten the wall sheets securely to the rails of the frame structure.

In the above described embodiments, the wall members have been fixed to horizontal frame members. This invention also allows members to be fixed to vertical frame members.

Figure 18:
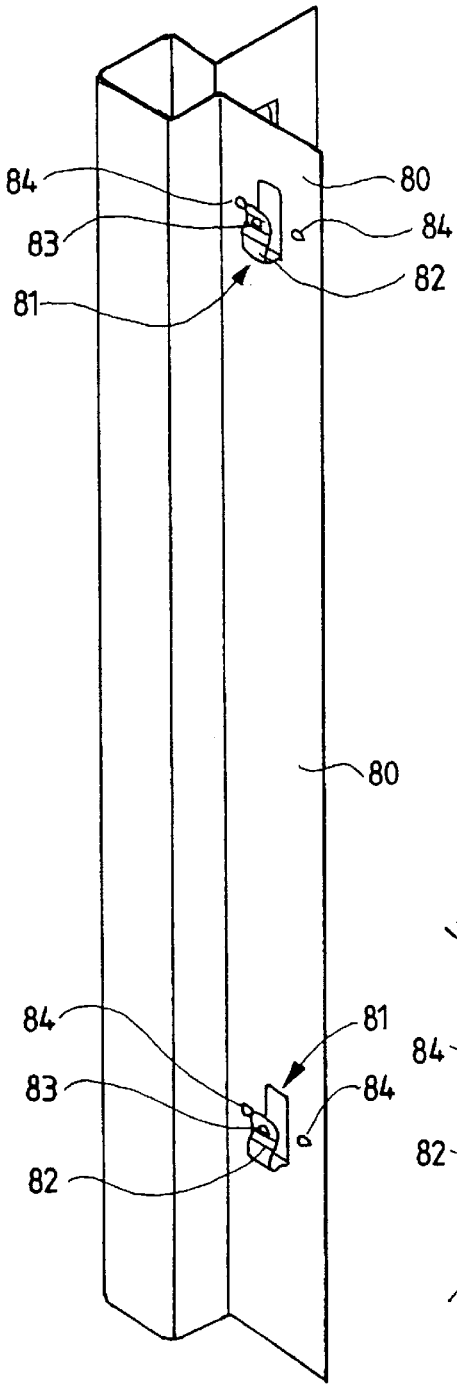
FIG. 18 is a perspective view of a post having clips according to another embodiment of the invention.
Figure 21:
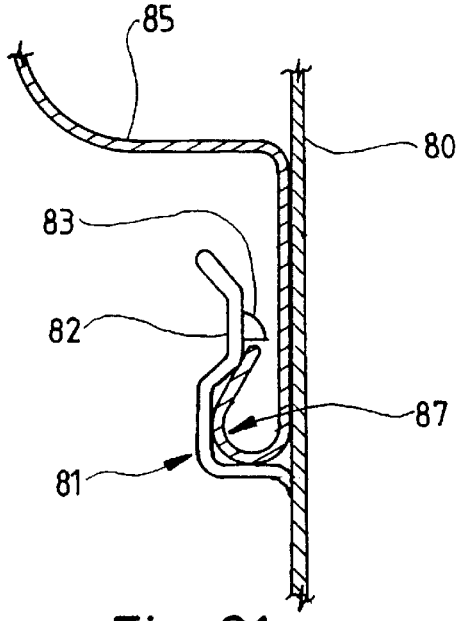
FIG. 21 is a sectional side view of the clip mounting of FIG. 20.

As shown in FIG. 18, a vertical frame member, in the form of a post 80, has clips 81 formed thereon at vertically spaced locations. Each clip 81 is formed by pressing out a flap 82 from the post 80. The flap 82 is preferably bent into a re-entrant profile as shown in FIG. 21, and has a detent 83 formed by pressing an indent or tab inwardly from the flap 82.

An additional pair of detents 84 are provided on either side of the clip 81. The detents are fixed in position and are formed by pressing out indents or tabs from the post 80.

Figure 20:
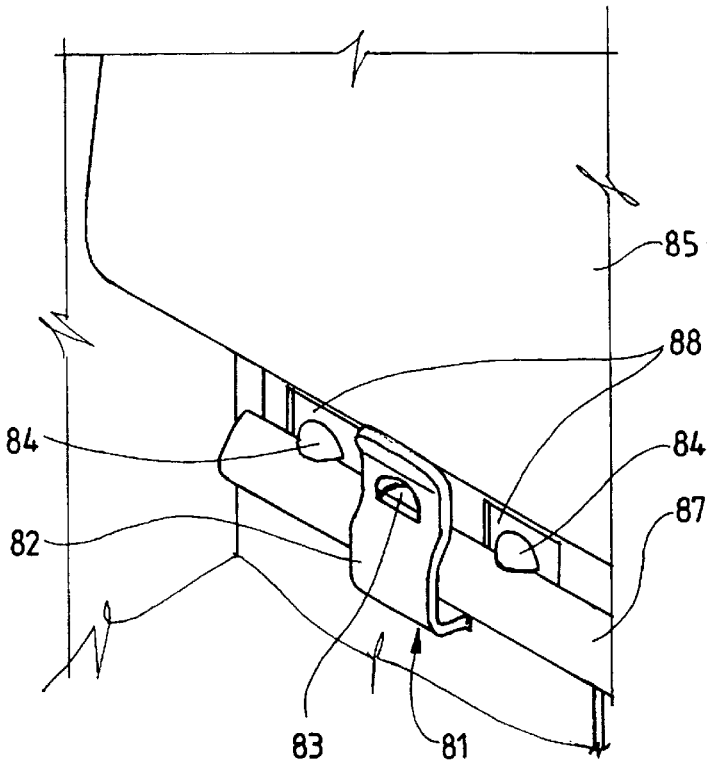
FIG. 20 is an enlarged perspective view of the clip mounting of FIG. 19.

The clips 81 are used to mount wall panels to the posts 80. The wall panels 85 are slat-like panels with half-rolled top and bottom edges 86, 87. Spaced apertures 88 are punched in the bottom edge portion of the panels 85, as shown in FIG. 20. The apertures 88 correspond in spacing and position with the detents 84.

In use, the wall panels are used to span between a pair of posts 80. The bottom rolled edge 87 of a panel 85 is pushed down into clips 81 on the spaced posts 80. When the bottom rolled edge 87 is pushed down into a clip 81, as shown in FIGS. 20 and 21, the flap 82 deflects outwardly to permit the rolled edge 87 to pass the detent 83. Once the rolled edge 87 has passed the detent 83, the resilient flap 82 springs back. The detent 83 prevents the bottom edge 87 from being lifted out of engagement with its respective clip 81.

Moreover, the detents 84 on the post 80 locate in apertures 88 in the wall panel 85. The detents 83, 84 thereby captively retain the wall panel 85 in the clips 81.

Figure 19:
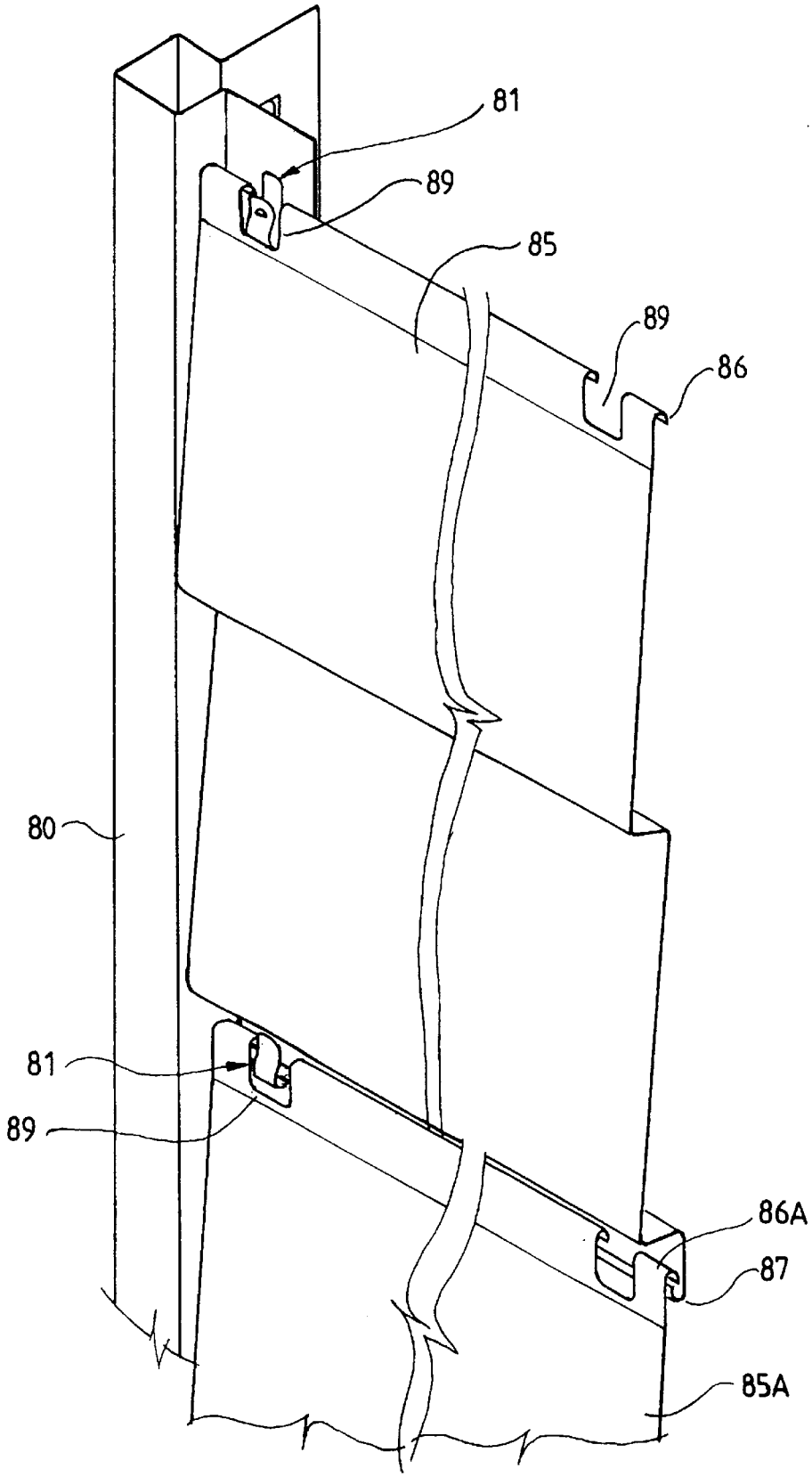
FIG. 19 is a perspective view showing wall panels being mounted to the clips on the post of FIG. 18.

Adjacent wall panels 85, 85A are joined to each other by hooking their adjacent rolled edges 87, 86A, as shown in FIG. 19. Suitable cut-outs 89 may be provided in the top of panels 85 to accommodate the clips 81.

The foregoing describes only some embodiments of the invention, and modifications which are obvious to those skilled in the art may be made thereto without departing from the scope of the invention as defined in the following claims.

What is claimed is:

1. An assembly for constructing a small metal building, including:

at least one elongate frame member;

a plurality of clip fittings attached or attachable to the frame member at spaced locations along a length of the frame member, each clip fitting comprises a flap juxtaposed with the frame member, having a resilient detent on the flap;

at least one generally planar wall member having a plurality of apertures adjacent an edge portion thereof at spaced locations corresponding to the clip fittings on the frame member, whereby the edge portion is insertable in the clip fittings to cause the detents to locate respectively in the apertures and captively retain the wall member to the frame member.

2. An assembly as claimed in claim 1, wherein the elongate frame member is a metal channel section which forms a rail of the building, and the wall member is a roll-formed metal sheet.

3. An assembly as claimed in claim 1 or 2, wherein each of the clip fittings is formed separately from the frame member but is attachable thereto.

4. An assembly as claimed in claim 3, wherein each clip fitting is generally U-shaped body having two spaced opposing sides, one side thereof having the detent(s) formed thereon and the other side having a hook portion for engaging the frame member.

5. An assembly as claimed in claim 1 or 2, wherein the clip fittings are formed integrally with the frame member.

6. An assembly as claimed in claim 1, wherein the flap is pressed out of the frame member in one direction, and the detent is an indent pressed out of the flap in the opposite direction.

7. An assembly as claimed in claim 1 or 6, further comprising at least one detent pressed out from the frame member, and located between two adjacent flaps.

8. An assembly for constructing a small metal building, including at least one post member having clip fittings at spaced locations thereon, each clip fitting having a resilient detent; and at least one wall panel member adapted to be mounted, in use, to the post member, the wall panel member having a rolled edge portion, whereby the rolled edge portion is insertable in the clip fitting in a snap-lock action such that the detent captively retains the rolled edge portion of the wall panel member in the clip fitting;

wherein each clip fitting is a flap pressed out from the post member, and the detent is an indent pressed into the flap.

9. An assembly as claimed in claim 8, wherein the post member has a pair of fixed detents located on respective opposite sides of each clip fitting, and wherein the wall panel member has a pair of spaced apertures adjacent the rolled edge portion, such that when the rolled edge portion is inserted into the clip fitting, the fixed detents locate respectively in the apertures and captively retain the wall panel member to the post member.

* * * * *